US006142710A

United States Patent [19]

Holland, Jr. et al.

[11] Patent Number: 6,142,710

[45] Date of Patent: Nov. 7, 2000

[54] APPARATUS AND METHOD FOR RAISING A FOUNDATION

[76] Inventors: Thomas Edward Holland, Jr., 2000 Ruddy Rd., Raleigh, N.C. 27616; Thomas Edward Holland, Sr., 352 Bethel Church Rd., Clover, S.C. 29710

[21] Appl. No.: 09/351,216

[22] Filed: Jul. 12, 1999

[51] Int. Cl.[7] ..... E02D 5/00

[52] U.S. Cl. ..... 405/230; 405/229

[58] Field of Search ..... 405/229, 230, 405/231, 254

[56] References Cited

U.S. PATENT DOCUMENTS

| | | | |
|---|---|---|---|
| 3,796,055 | 3/1974 | Mahony . | |
| 3,902,326 | 9/1975 | Langenbach, Jr. . | |
| 4,634,319 | 1/1987 | May | 405/230 |
| 4,673,315 | 6/1987 | Shaw et al. . | |
| 4,695,203 | 9/1987 | Gregory . | |
| 4,765,777 | 8/1988 | Gregory . | |
| 4,800,700 | 1/1989 | May . | |
| 4,854,782 | 8/1989 | May | 405/230 |
| 4,911,580 | 3/1990 | Gregory et al. | 405/230 |
| 4,925,345 | 5/1990 | McCown, Jr. et al. . | |
| 5,006,015 | 4/1991 | Stephens et al. . | |
| 5,011,336 | 4/1991 | Hamilton et al. . | |
| 5,013,190 | 5/1991 | Green | 405/230 |
| 5,056,750 | 10/1991 | Ellithorpe . | |
| 5,120,163 | 6/1992 | Holdeman et al. . | |
| 5,123,209 | 6/1992 | Nally | 405/229 |
| 5,135,335 | 8/1992 | Stephens et al. | 405/230 |
| 5,139,368 | 8/1992 | Hamilton et al. . | |
| 5,154,539 | 10/1992 | McCown, Sr. et al. | 405/230 |
| 5,171,107 | 12/1992 | Hamilton et al. . | |
| 5,176,472 | 1/1993 | Kinder | 405/230 |
| 5,205,673 | 4/1993 | Bolin et al. . | |
| 5,213,448 | 5/1993 | Seider et al. . | |
| 5,217,325 | 6/1993 | Freeman, III | 405/229 |
| 5,234,287 | 8/1993 | Rippe, Jr. | 405/230 |
| 5,246,311 | 9/1993 | West et al. | 405/230 |
| 5,269,630 | 12/1993 | Bolin et al. | 405/230 |
| 5,433,556 | 7/1995 | Freeman, III | 405/229 |
| 5,492,437 | 2/1996 | Ortiz . | |
| 5,722,798 | 3/1998 | Gregory | 405/230 |
| 5,724,781 | 3/1998 | Matthias et al. . | |
| 5,800,094 | 9/1998 | Jones | 405/230 |
| 5,951,206 | 9/1999 | Gregory | 405/230 |

*Primary Examiner*—James A. Lisehora
*Assistant Examiner*—Alexandra K. Pechhold
*Attorney, Agent, or Firm*—Alston & Bird LLP

[57] ABSTRACT

A lifting assembly for raising and supporting an edge of a foundation includes a lifting saddle slidably received over a pier that is driven into the ground adjacent the edge of the foundation, a bracket supported by the lifting saddle and adapted to be affixed to and to support the foundation, and a load transfer device configured to be supported atop an upper end of the pier. The lifting saddle is connected to the load transfer device by threaded rods slidably received through the load transfer device. The bracket is pivotally connected to the lifting saddle such that the bracket can rock side-to-side, thus self-aligning and remaining aligned with the foundation during a lifting operation. The bracket can also pivot about a vertical axis and can slide in a forward or rearward direction relative to the lifting saddle. The lifting saddle can pivot relative to the pier about a horizontal axis.

29 Claims, 3 Drawing Sheets

10
46
54
18
52
22
16
64
66
20
3
3
44
48
28
40
30
14
12

54
52
18
50
22
16
24
20
46
56
46
64
66
34
30
44

60
36
28
14
12
64,66
46
44
14
28
12
60
16
40
34
30
56
64,66
46
44

APPARATUS AND METHOD FOR RAISING A FOUNDATION

FIELD OF THE INVENTION

The invention relates to devices and methods for raising building foundations such as footers, slabs, or the like. The invention relates more particularly to devices and methods employing piers driven into the ground at the edge of a foundation to be raised, and lifting devices that engage the foundation and the piers for raising and supporting the edge of the foundation.

BACKGROUND OF THE INVENTION

Many types of building structures are supported by foundations that in turn are supported by soil rather than by more stable bedrock or other supporting strata. Shifting of the supporting soil over time can cause the foundation to sink, which can lead to various problems including structural damage. Unless the foundation is supported, further shifting can occur and worsen the structural damage. Furthermore, it is frequently desirable to raise the foundation to its original level in order to facilitate restoration of the structure to a proper condition.

Accordingly, many devices and methods have been developed or proposed for raising and supporting a foundation. Many such devices and methods employ piers that are driven into the ground adjacent an edge of the foundation until the piers encounter bedrock or other relatively firm supporting strata. Jacking devices are used for jacking up the edge of the foundation, using the piers for support. When the foundation is raised to the desired level, the foundation is affixed to the piers and the jacking equipment is removed.

In some such lifting devices, brackets are affixed to the foundation and are slidably engaged with the piers, and the jacking devices engage the brackets for raising the foundation. A bracket typically includes a pier-receiving portion such as a collar or sleeve that surrounds the pier in close-fitting fashion, and a support plate rigidly affixed to the pier-receiving portion and configured to engage a lower surface of a foundation. The pier-receiving portion is sized to fit closely about the pier so that the bracket is able to slide upward and downward along the pier but is substantially prevented from moving in any other direction. A disadvantage of this approach is that substantial bending moments can be exerted on the pier if the support plate is at an angle other than perpendicular to the pier, such as may occur if the foundation changes its orientation during a lifting operation. In some cases, bending moments great enough to cause failure of the pier can be exerted as a result of misalignment between the foundation and the pier. Furthermore, misalignment between the bracket and the foundation can result in point loads being exerted on the foundation, which in some cases can cause damage to the foundation, such as cracking.

U.S. Pat. No. 5,213,448 discloses an underpinning bracket for a foundation, in which a sleeve is placed over the upper end of an anchor rod screwed into the ground adjacent the edge of a foundation. The sleeve is bonded to the anchor rod. A bracket is slidably received over the sleeve and attached to the foundation. A jack is used for raising the bracket upward along the sleeve. The amount of vertical lift that can be achieved is limited by the length of the sleeve, since the bracket must be mounted about the sleeve. The '448 patent does not address the problem of misalignment between the bracket and the foundation.

SUMMARY OF THE INVENTION

The above needs are met and other advantages are achieved by the present invention, which provides an improved lifting assembly and method for raising and supporting a foundation, in which a bracket that supports the edge of the foundation is able to pivot about at least one axis, and preferably about more than one axis, relative to the pier such that the bracket self-aligns and remains aligned with the foundation throughout a lifting operation. The invention thus facilitates significant reduction in pier bending moments caused by foundation misalignment, and enables the forces exerted on the foundation by the bracket to be more-evenly distributed such that there is less susceptibility of damage being done to the foundation. In other embodiments of the invention, the bracket is configured to be slidable on the lifting saddle along a horizontal direction, preferably in a forward or rearward direction toward or away from the foundation, so as to accommodate movement or misalignment of the foundation in the horizontal direction. In still further preferred embodiments of the invention, the bracket can pivot about one or more axes and can also slide horizontally so as to provide substantial freedom of movement of the bracket relative to the lifting saddle and pier. Yet other embodiments of the invention include a lifting saddle configured to be pivotable relative to the pier about a horizontal axis.

To these ends, a lifting assembly for a foundation in accordance with one preferred embodiment of the invention comprises a lifting saddle constructed to engage the pier such that the lifting saddle is slidable upward and downward along the pier, and a bracket adapted to engage the edge of the foundation. The lifting saddle is configured to support the bracket such that upward movement of the lifting saddle causes the bracket to lift the edge of the foundation. At least one of the bracket and lifting saddle is configured to allow the bracket to pivot about a horizontal axis relative to the pier.

The lifting saddle advantageously includes a generally horizontal support member configured to project from the pier toward the edge of the foundation. The bracket includes a generally horizontal portion having a generally planar upper surface adapted to engage a lower surface of the edge of the foundation, the generally horizontal portion of the bracket resting upon the generally horizontal support member of the lifting saddle. Preferably, the bracket includes a convex member affixed to an under surface of the generally horizontal portion of the bracket, the convex member making rolling contact with the generally horizontal support member of the lifting saddle so as to enable the bracket to pivot about a horizontal axis. The horizontal pivot axis of the bracket preferably is oriented generally perpendicular to the edge of the foundation so that the bracket can rock side-to-side relative to the lifting saddle.

In another preferred embodiment of the invention, the bracket is slidably supported on the generally horizontal support member of the lifting saddle such that the bracket can slide toward and away from the foundation. A member advantageously is provided for captively retaining the bracket in connection with the lifting saddle while permitting the sliding motion of the bracket. Conveniently, a convex member can be affixed to an under surface of the bracket such that the convex member makes rolling and sliding contact with the generally horizontal support member of the lifting saddle, and a retaining member can be passed through the convex member and affixed to the lifting saddle. Still more preferably, the convex member and retaining member can be constructed to also enable the bracket to pivot about a vertical axis relative to the lifting saddle. Thus, the invention facilitates at least one and preferably multiple degrees of freedom of movement of the bracket relative to the lifting saddle and pier, thereby reducing the likelihood of damage to the pier and/or foundation caused by misalignment between the foundation and bracket.

Preferably, the lifting saddle is constructed so as to be pivotable on the pier about a horizontal axis that extends generally parallel to the edge of the foundation. When the pivotable lifting saddle is used in conjunction with the pivotable and/or slidable bracket, the invention enables the bracket to pivot and/or slide about multiple axes relative to the pier. A preferred embodiment of a pivotable lifting saddle comprises a pair of spaced-apart side members, a forward transverse member connected between the side members, and a rear transverse member spaced from the forward transverse member and connected between the side members. The side members and transverse members collectively define a pier-receiving passage through which a pier can be received. The pier-receiving passage is sized slightly larger than the pier such that the lifting saddle can slide up and down along the pier. The horizontal distance between the forward and rear transverse members exceeds the maximum dimension of the pier in the horizontal direction by a further amount beyond that required for enabling the pier to slide up and down. This additional spacing between the transverse members enables the lifting saddle to pivot on the pier about a horizontal axis that is generally parallel to the edge of the foundation.

In accordance with a further preferred embodiment of the invention, the lifting assembly includes a load transfer device adapted to engage an upper end of a pier, and lifting and support members connected to the load transfer device and to the lifting saddle for suspending the lifting saddle from the load transfer device. Preferably, the load transfer device is configured for engaging a tubular upper end portion of a pier or a tubular extension added onto the upper end of a pier, the load transfer device including a vertical portion adapted to be slidably received within the pier or pier extension and a support portion adapted to rest atop an upper end of the pier or pier extension. Alternatively, the load transfer device can be formed with a short tubular section that receives the upper end of a pier, such as a solid pier, and the lifting saddle can slidably engage the pier below the short tubular section. The lifting saddle includes lifting ears formed on opposite sides of the lifting saddle, and the lifting and support members engage the lifting ears for raising the lifting saddle upward on the pier. Because the lifting saddle slides along the outside of the pier, the amount of vertical lift that can be achieved is limited only by the length of the lifting and support members.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In the following description and claims, certain terms of direction and orientation are used, including "upper", "lower", "upward", "downward", "forward", "rear", "vertical", "horizontal", and the like. It is to be understood that these terms refer to directions relative to a foundation of a building structure. Thus, "upper" and similar terms connote a direction or orientation generally away from the center of the earth, and "lower" and similar terms connote a direction or orientation generally toward the center of the earth. "Vertical" and "horizontal" are relative to the direction of gravity. "Forward" is meant to indicate a direction generally horizontally toward a foundation and "rear" is meant to indicate a direction generally horizontally away from a foundation. It will be understood, however, that these various terms are used solely for the purpose of clarity and are not intended to be limiting in any way.

Figures 1, 2, 3:
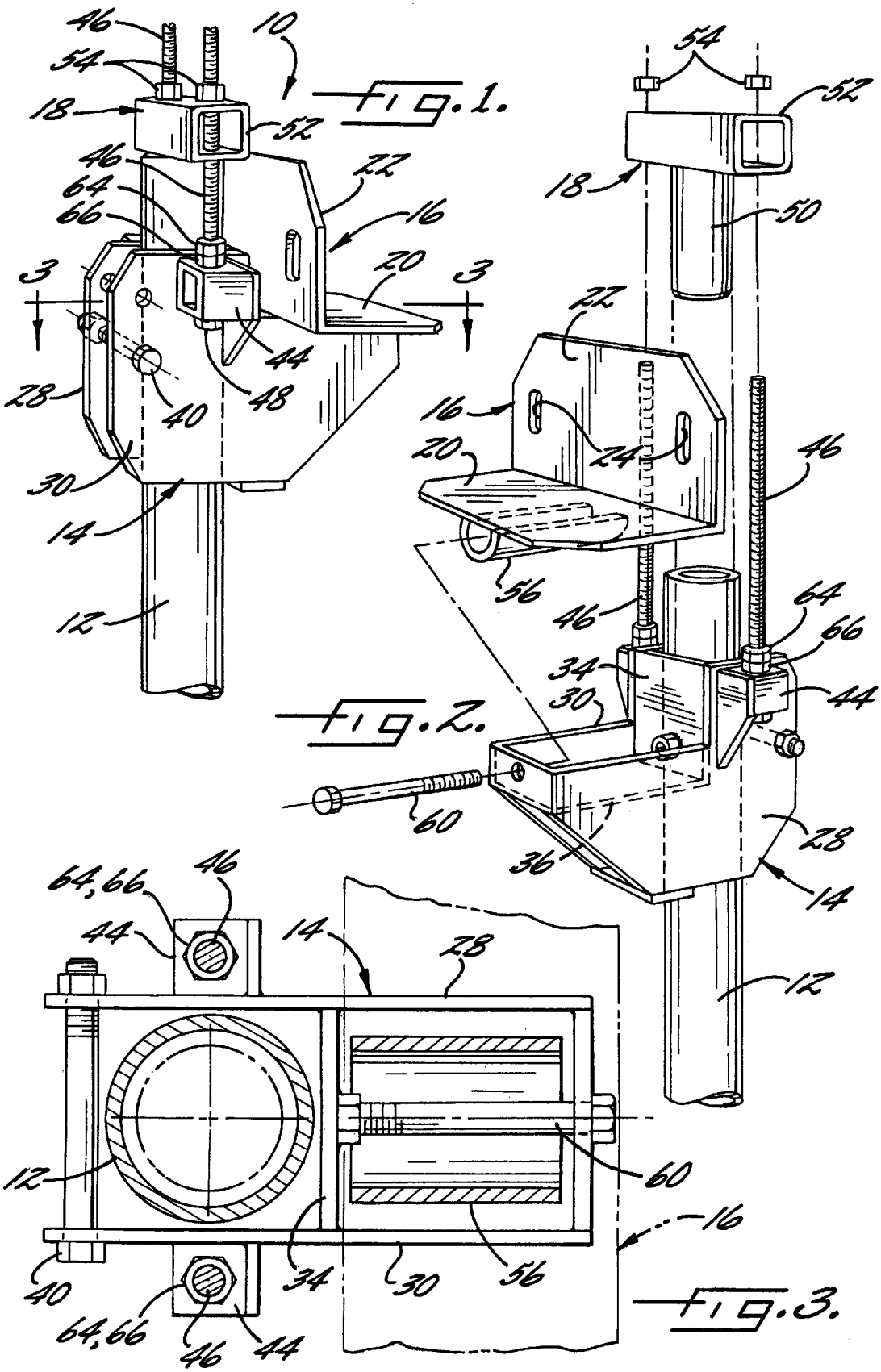
FIG. 1 is a perspective view of a lifting assembly in accordance with a preferred embodiment of the invention.
FIG. 2 is an exploded view of the lifting assembly of FIG. 1.
FIG. 3 is a cross-sectional view taken on line 3—3 of FIG. 1.
Figure 4:
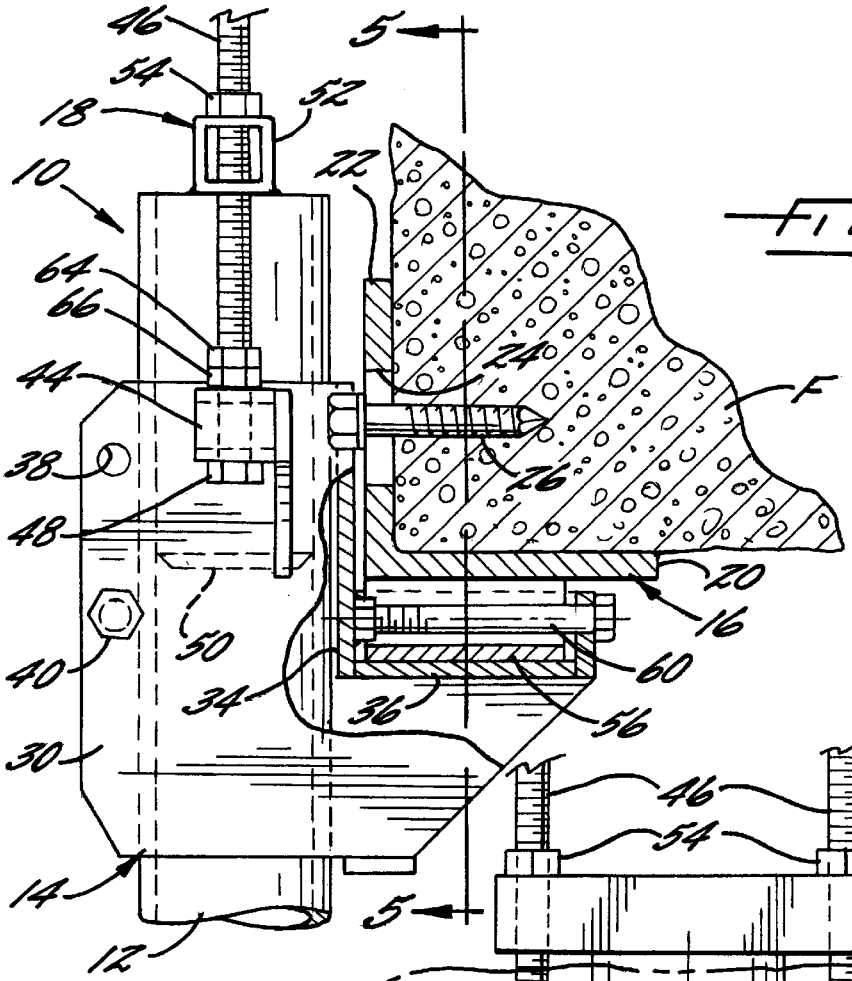
FIG. 4 is a side elevation, partially in section, of the lifting assembly shown in engagement with a foundation.
Figure 5:
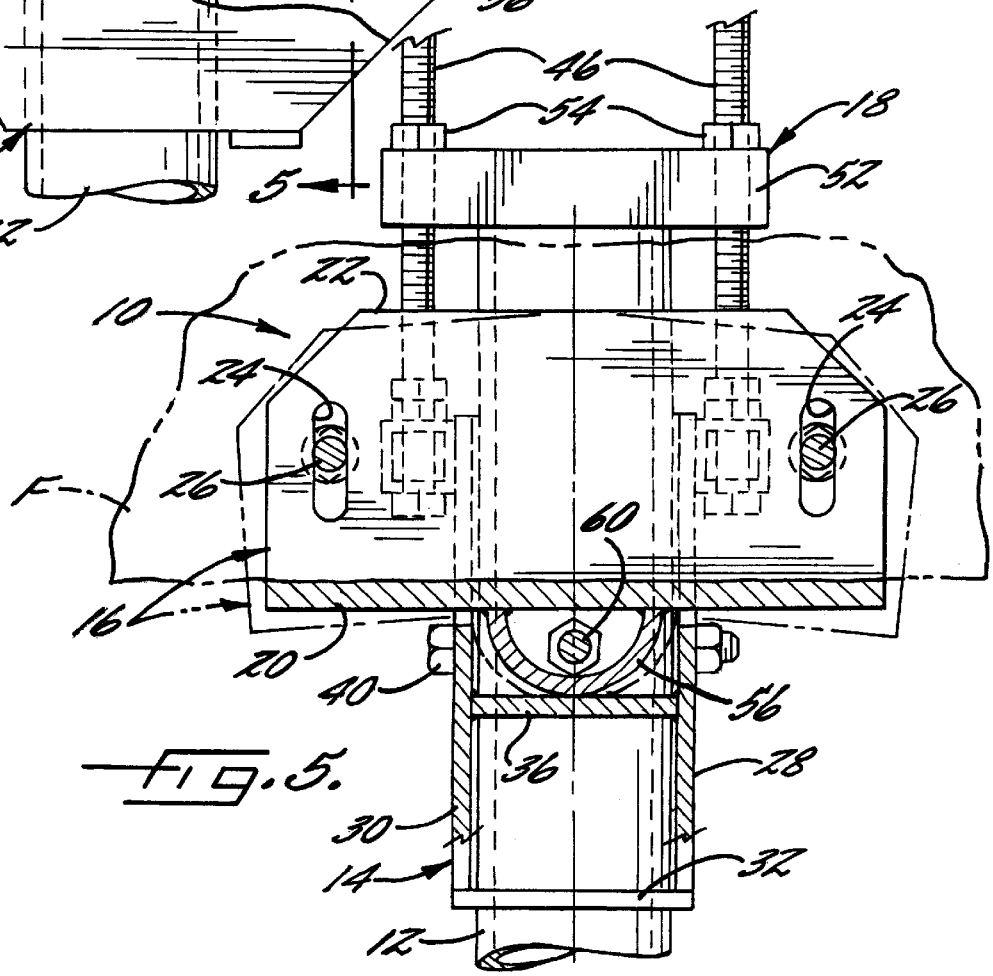
FIG. 5 is a cross-sectional view taken on line 5—5 of FIG. 4.
Figure 6:
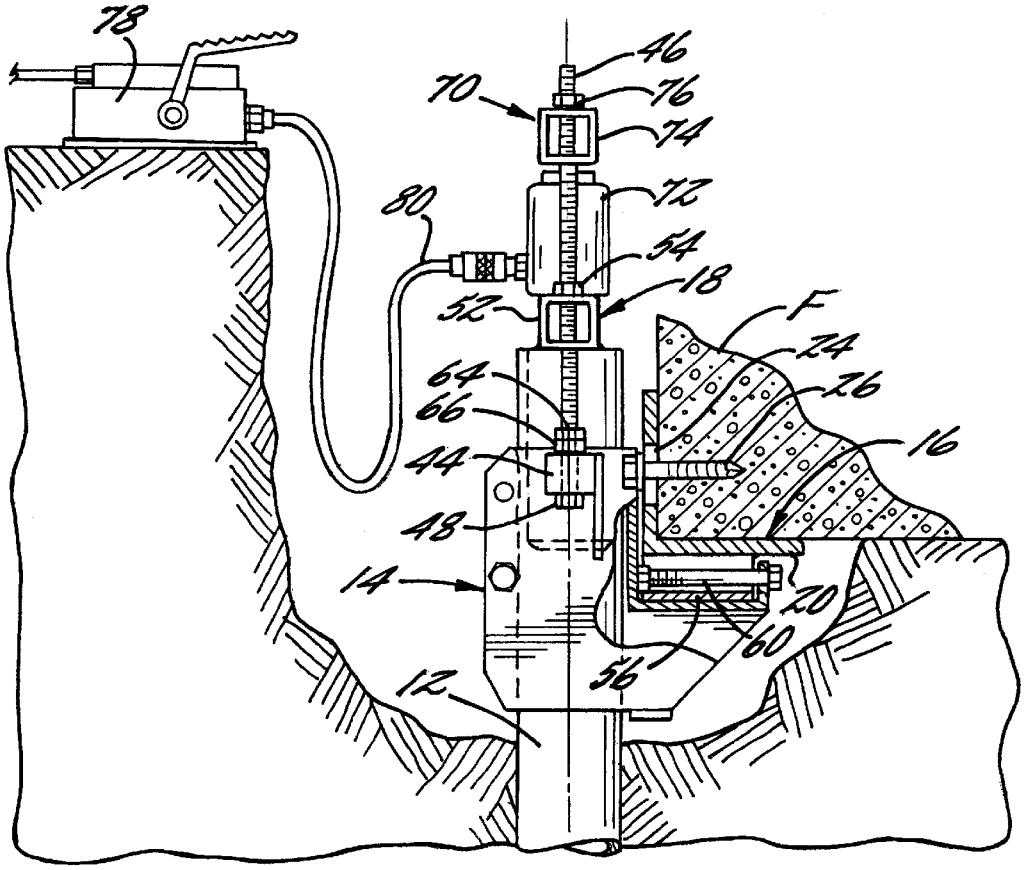
FIG. 6 is a side elevation of the lifting assembly in use, showing a jacking device positioned for raising the lifting saddle and bracket.
Figure 7:
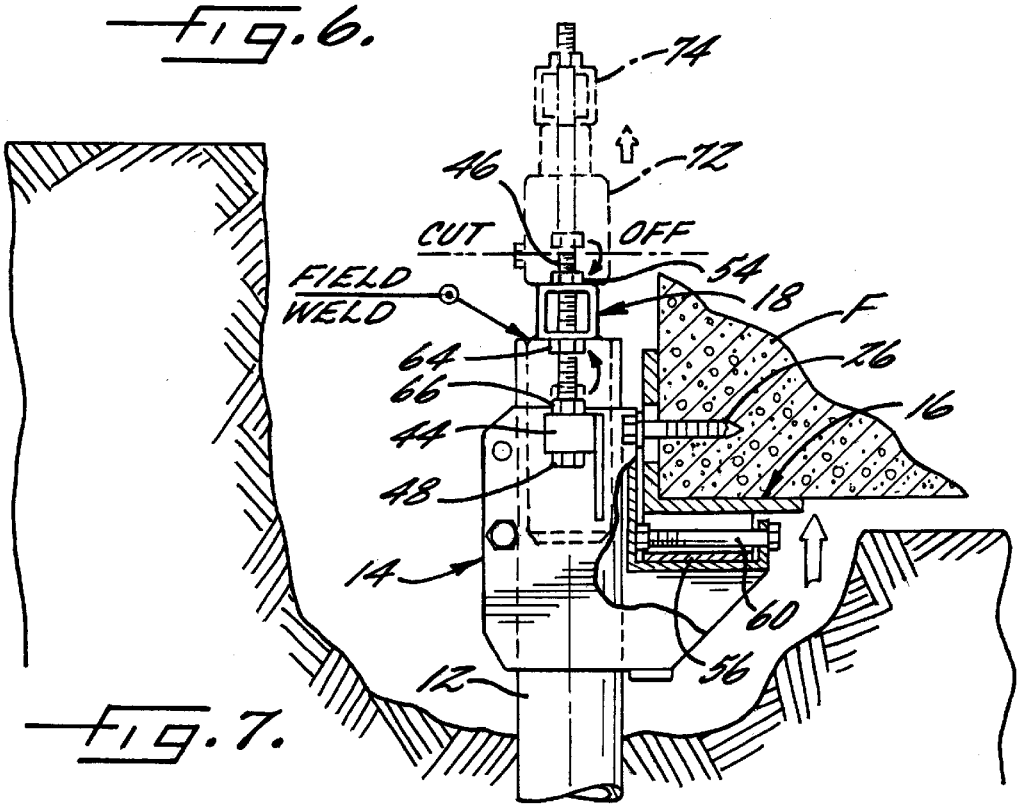
FIG. 7 is a view similar to FIG. 6, showing the jacking device being removed and a field weld of the load transfer device to the pier being formed after the foundation is raised.

FIGS. 1–3 depict one preferred embodiment of a foundation lifting assembly 10 in accordance with the present invention, and FIGS. 4–7 illustrate a typical usage of the lifting assembly for raising a foundation. The lifting assembly 10 is constructed to cooperate with a pier 12 that is positioned in the ground adjacent the edge of a foundation F, as best seen in FIGS. 6 and 7. A plurality of piers 12 are typically located in the ground spaced apart along the edge of a foundation. The piers 12 can be formed of various materials including metal, composite, wood, concrete, or any other material capable of being formed into elongate column-like structures that are able to support the loads expected to be encountered in use. The piers 12 typically extend down into the ground a sufficient depth such that their lower ends encounter supporting strata capable of providing sufficient support to enable the foundation to be raised using the piers as support. Each pier 12 can have any of a variety of configurations, including rod-shaped or pipe-shaped structures of round or polygonal cross-section. A pier 12 can be formed of multiple sections linked end-to-end in suitable fashion. The piers 12 can be positioned in the ground in various ways. For example, the piers can be driven into the ground by a pile-driving technique, inserted into he ground with the aid of a water jet, or formed in place by excavating a hole and pouring a concrete or similar composition into the hole. If desired, the piers 12 can be provided with helical flights (not shown) on their lower ends such that they can be screwed into the ground. In the illustrated embodiment of the invention, the pier 12 comprises a tubular pipe-shaped structure, but the invention is not limited to any particular pier configuration or type.

The lifting assembly 10 comprises a lifting saddle 14, a bracket 16, and a load transfer device 18. The bracket 16 is configured to support an edge portion of the foundation F, and to this end, the bracket 16 includes a generally horizontal portion 20 having a generally planar upper surface for supporting a generally planar lower surface of the foundation, and a generally vertical portion 22 having a generally planar surface for abutting a generally planar outer surface of the foundation (FIG. 4). The vertical portion 22 preferably includes apertures 24 therethrough for the passage of bolts or concrete anchors 26 so that the bracket 16 can be fixedly secured to the edge of the foundation F after the edge of the foundation is exposed by excavation.

The lifting saddle 14 includes a pair of parallel side members 28 and 30 preferably in the form of vertically oriented plate-shaped members. The side members 28, 30 are horizontally spaced apart by a distance slightly exceeding the outer diameter of the pier 12. Forward portions of the side members 28, 30 are joined by a transverse member 32 connected between lower ends of the side members, and are also joined by a generally vertical plate-shaped member 34 connected between the side members adjacent upper edges thereof. A generally horizontal support member 36 is joined to a lower edge of the vertical member 34 and extends forward therefrom. The vertical member 34 is in vertical alignment with a rear edge of the transverse member 32. Accordingly, the pier 12 can be received between the side members 28 and 30 and can be positioned in abutment with both the transverse member 32 and the vertical member 34 such that the horizontal support member 36 projects generally perpendicularly away from the pier 12, as shown in FIG. 4.

The side members 28 and 30 are configured to provide rear portions that extend rearward of the pier 12 when the pier is in abutment with the transverse member 32 and the vertical member 34, and holes 38 are formed through the rear portions of both side members 28, 30 for the passage of a bolt 40 or other elongate member so as to extend between the side members. The bolt 40 serves as the fourth side of a four-sided pier-receiving passage 42 (FIG. 3), the other three sides being formed by the two side members 28 and 30 and the vertical member 34 and transverse member 32. Preferably, as best seen in FIG. 4, each side member 28, 30 includes a plurality of holes 38 aligned with corresponding holes 38 in the other side member, such that the bolt 40 can be selectively positioned in one of the sets of the holes 38. All of the holes 38 are horizontally spaced from the transverse member 32 by a distance that exceeds the horizontal dimension of the pier 12. As a result, the saddle 14 is able to rotate through a limited range of angles about a horizontal axis. That is, when the forward transverse member 32 is abutting the pier 12, the saddle 14 can rotate about the transverse member 32 in one direction until bolt 40 abuts the rear side of the pier 12 and in the other direction until the wall member 34 abuts the forward side of the pier. At least one of the holes 38 in each side member 28, 30 is spaced a greater horizontal distance away from the forward transverse member 32 than the other holes 38. For example, as shown in FIG. 4, the middle hole 38 can be spaced farther from the transverse member 32 than the other two holes. Alternatively, all of the holes 38 can be spaced different distances from the transverse member 32. Thus, by placing the bolt 40 in a different one of the holes 38, the maximum amount of rotation of the saddle 14 can be varied as desired. It should also be noted that although the transverse member 32 is illustrated as being a plate- or bar-shaped member affixed to the side members 28, 30, alternatively the transverse member 32 could be formed by a bolt or pin passed through holes formed in forward portions of the side members 28, 30 similar to the arrangement of holes 38 and bolt 40. It will further be recognized that although the embodiment illustrated has multiple holes 38 formed in the rear portions of the side members 28, 30 for enabling the amount of pivotal movement of the lifting saddle 14 to be selectively adjusted, it is possible to provide this adjustability by instead forming multiple holes in the forward portions of the side members 28, 30 at different distances from a rear transverse member.

The lifting saddle 14 includes a pair of lifting ears 44, one ear 44 being affixed to each of the side members 28 and 30. The lifting ears 44 preferably comprise box-like members welded onto the side members 28, 30. Holes are formed through the lifting ears 44 for the passage of rod-like lifting and support members 46 vertically through the lifting ears. At least the lower ends of the lifting and support members 46 that project below the lifting ears 44 are threaded, and nuts 48 are threaded onto the lower ends.

The lifting saddle 14 is slid over the pier 12 such that an upper end of the pier projects upwardly from the pier-receiving passage 42 above the upper edges of the lifting saddle. The lifting and support members 46 extend upwardly on opposite sides of the pier 12 and project above the upper end of the pier.

The load transfer device 18 comprises a generally T-shaped structure having a generally vertical portion 50 sized to be slidably received into the open upper end of the pier 12, and a generally horizontal portion 52 having a length such that opposite end portions overhang the pier 12 on opposite sides thereof when the horizontal portion 52 is resting upon the upper end of the pier. It should be noted that the vertical portion of the load transfer device alternatively can be formed by a short tubular section that receives the upper end of the pier 12 therein, in which case the pier 12 could be a solid pier such as a rod, post, or the like. The horizontal portion 52 has holes formed therethrough for the passage of the lifting and support members 46 through the horizontal portion 52 such that upper ends of the lifting and support members project above the horizontal portion 52. Nuts 54 are threaded onto the lifting and support members 46 above the horizontal portion 52 of the load transfer device 18. Accordingly, the lifting saddle 14 is suspended from the load transfer device 18 by virtue of the connection therebetween provided by the lifting and support members 46, the nuts 48 below the lifting ears 44, and the nuts 54 above the load transfer device 18. The lifting saddle 14 is thereby prevented from moving downward relative to the load transfer device 18. The load transfer device 18 in turn rests upon the upper end of the pier 12.

The bracket 16 having the foundation F supported thereon is supported by the horizontal support member 36 of the lifting saddle 14. More particularly, and as best seen in FIG. 5, a convex member 56 is affixed to the lower surface of the horizontal member 20 of the bracket 16, and the convex member 56 rests upon the upper surface of the horizontal support member 36. The lifting saddle 14 preferably includes a transversely extending forward wall member 58 joined to a forward edge of the horizontal support member 36 and extending thereabove, and the forward portions of the side members 28 and 30 preferably are joined to opposite side edges of the horizontal support member 36 and extend thereabove, such that the convex member 56 is restrained by the forward wall member 58 from moving forwardly and is restrained by the side members 28 and 30 from sliding laterally off the horizontal support member 36. The convex member 56 additionally includes a passage therethrough for receiving a retaining bolt 60 which also extends through a hole in the forward wall member 58. The threaded end of the retaining bolt 60 is threaded into a nut 62 affixed to the vertical member 34 of the lifting saddle. Thus, the bracket 16 is captively retained on the lifting saddle 14 by the retaining bolt 60.

The convex member 56 can roll along the upper surface of the generally horizontal support member 36 in a transverse direction that is generally parallel to the edge of the foundation F. By virtue of this rolling contact provided by the convex member 56, the bracket 16 is pivotal relative to the lifting saddle 14, about a horizontal axis that is perpendicular to the rolling direction and thus is generally perpendicular to the edge of the foundation F to be raised, as illustrated in FIG. 5. The bracket 16 accordingly can rock side-to-side in a pivotal fashion so as to self-align with the foundation F and to remain aligned with the foundation F during a raising operation. It will thus be appreciated that the downward force of the foundation F onto the bracket 16 is transferred to the lifting saddle 14 without any substantial moment being exerted on the lifting saddle. Accordingly, the force that is transferred from the lifting saddle 14 through the lifting and support members 46 to the load transfer device 18 and onto the pier 12 is substantially a pure downward force with little or no lateral component or moment. Bending moments on the pier 12 are thereby significantly reduced, making failure of the pier 12 less likely. Furthermore, the ability of the bracket 16 to pivot about the horizontal axis also tends to promote a uniform distribution of pressure between the bracket 16 and the foundation so that point loads on the foundation are prevented and thus damage to the foundation can be reduced.

It will also be noted that the convex member 56 preferably has a length measured in the forward-rear direction (i.e., along the axis of the bolt 60 as best seen in FIG. 3) that is somewhat less than the distance from the vertical member 34 to the forward wall member 58 between which the convex member 56 is disposed. Accordingly, the bracket 16 has a certain amount of play in the forward or rearward direction relative to the saddle 14 and thus can slide forward or rearward so as to accommodate forward or rearward movement of the foundation. The convex member 56 preferably also is narrower in the transverse direction than the space between the upper portions of the side members 28, 30 between which the convex member 56 is disposed such that there is a certain amount of transverse play between the bracket 16 and the saddle 14. The combination of forward-rearward play and transverse play between the bracket 16 and saddle 14 enables the bracket 16 to pivot relative to the saddle 14 about a vertical axis generally parallel to the pier. It will thus be appreciated that the bracket 16 and saddle 14 provide multiple degrees of freedom of movement of the bracket 16 relative to the saddle 14 and relative to the pier 12 so that the bracket 16 can stay aligned with the foundation F and point loads on the foundation can be avoided or reduced, and the force ultimately transmitted to the pier is purely compressive along the pier or nearly so. Reduced pier bending stresses and reduced susceptibility to damage to the foundation caused by misalignment between the foundation and the bracket 16 are thus facilitated by the invention.

The use of the lifting assembly 10 is now described with reference to FIGS. 6 and 7. An edge portion of a foundation F is first exposed by excavating the earth from beside and beneath the edge portion. At spaced intervals along the edge of the foundation F, brackets 16 are affixed to the foundation as previously described. If desired, the lower surface and outer surface of the foundation F can first be machined to present flat surfaces for engagement by the bracket 16. At the location of each bracket 16, a lifting saddle 14 is connected to the bracket 16 by the retaining bolt 60 as previously described. A pier 12 is inserted downward through the lifting saddle 14 and is driven by suitable means (not shown) into the ground in a generally vertical direction. Alternatively, the piers 12 can be driven into the ground prior to the brackets 16 and lifting saddles 14 being positioned. If necessary, multiple pier sections can be connected together to form a longer pier. The pier 12 is driven downward until it encounters supporting strata capable of supporting the portion of the weight of the foundation F to be supported by the pier. An upper end portion of the pier 12 is left projecting above the lifting saddle 14 by a distance preferably somewhat exceeding a vertical distance by which the foundation is to be raised. The upper end portion of the pier 12 is tubular. It should be noted that the entire pier 12 can be made tubular, or, alternatively, the pier 12 can be solid over the majority of its length and only the upper end portion 12 can be tubular. This tubular portion if desired can be a separate pier extension (not shown) connected to the upper end of a solid pier.

A load transfer device 18 is inserted into the tubular upper end of the pier 12. It should be noted that although a tubular pier 12 is shown as having circular cross section, the term "tubular" as used herein is intended to refer more generally to tubular members having any of various cross sections including square cross sections or other cross-sectional shapes. The lifting and support members 46 are passed through the holes in the load transfer device 18 until lower ends of the lifting and support members 46 are positioned between the load transfer device 18 and the lifting ears 44 of the lifting saddle. Two nuts 64 and 66 are threaded onto the lower ends of each of the lifting and support members 46 and are run upward a sufficient distance to allow the lower ends of the lifting and support members 46 to be inserted through the lifting ears 44. Nuts 48 are threaded onto the lower ends of the lifting and support members 46. The nuts 64 and 66 are positioned below the lower surface of the load transfer device 18 by a distance at least equal to and preferably exceeding a vertical distance by which the foundation F is to be raised. Nuts 54 are threaded onto the upper ends of the lifting and support members 46 that project above the upper surface of the load transfer device 18 and are run down until they abut the load transfer device.

Next, a jacking assembly 70 is connected to the lifting and support members 46 for raising them upward. More particularly, a hydraulic or pneumatic jack 72 is positioned atop the load transfer device 18 between the two lifting and support members 46. A lifting beam 74 having holes for the passage of the lifting and support members 46 therethrough is slid over the lifting and support members 46 and downward until it rests upon the jack 72. Upper ends of the lifting and support members 46 project above the lifting beam 74, and nuts 76 are threaded onto these upper ends and are run down into abutment with the upper surface of the lifting beam 74. The jack 72 is then operated, such as by a pump device 78 that supplies pressurized fluid through a hose 80 connected with the jack 72, to cause the jack 72 to extend and thereby raise the lifting beam 74 upward relative to the load transfer device 18. Upward movement of the lifting beam 74 causes the lifting and support members 46 to pull the lifting saddle 14 upward, which in turn lifts the bracket 16 and foundation F. The jack 72 is operated to raise the foundation F by a desired amount, and then the nuts 54 are run down along the lifting and support members 46 until they abut the upper surface of the load transfer device 18, as shown in FIG. 7.

The jack 72 is then retracted and the jacking assembly 70 is removed. The portions of the lifting and support members 46 projecting above the nuts 54 are cut off and removed. A field weld preferably is performed to affix the load transfer device 18 to the pier 12 as shown in FIG. 7. The nuts 64 are run up along the lifting and support members 46 until they abut the lower surface of the load transfer device 18. The nuts 66 are positioned in abutment with the upper surfaces of the lifting ears 44. Thus, downward movement of the lifting saddle 14, and therefore of the foundation F, is prevented by the load transfer device 18 resting atop the pier 12, by the nuts 54 atop the load transfer device, and by the nuts 48 below the lifting ears 44. Additionally, upward movement of the foundation F is prevented by the restraining bolt 60, by the nuts 66 above the lifting ears 44, by the nuts 64 below the load transfer device 18, and by the field weld of the load transfer device 18 to the pier 12.

Many modifications and other embodiments of the invention will come to mind to one skilled in the art to which this invention pertains having the benefit of the teachings presented in the foregoing descriptions and the associated drawings. For example, although in the illustrated embodiment, pivotal movement of the bracket 16 relative to the lifting saddle 14 is provided by a convex member 56 affixed to the bracket 16, it will be recognized that alternatively the upper surface of the lifting saddle on which the bracket rests could be made convex while the lower surface of the bracket is flat. It will also be recognized that while the convex member 56 is shown as presenting a cylindrical surface for contact with the support member 36 of the lifting saddle, other convex shapes can be used instead, including spherical, ellipsoid, or the like. While a cylindrical contact surface such as that presented by the convex member 56 provides rolling motion in only one direction and hence the ability for the bracket 16 to pivot about only one horizontal axis, a spherical contact surface would provide rolling motion in any direction and thus the ability for the bracket 16 to pivot about any horizontal axis, which may be beneficial in some applications. Moreover, it will be recognized that a pivotal connection between the bracket and lifting saddle can be effected by a pivotal bearing arrangement, such as a pin affixed to one of the members and received within a sleeve affixed to the other member. Other types of pivotal connections between the bracket and saddle can be used, such as a ball-and-socket type bearing or the like. The main consideration involved in the design of the interface between the bracket and the lifting saddle is that the bracket 16 have freedom of movement relative to the saddle 14 so that the bracket 16 is able to accommodate and adjust to a misaligned foundation. Furthermore, alternative arrangements for captively retaining the bracket in connection with the lifting saddle can be used in place of the retaining bolt 60. Other changes can also be made to the illustrated embodiment. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A lifting assembly for use in conjunction with a pier driven generally vertically into the ground proximate an edge of a foundation for lifting the edge of the foundation, comprising:

a lifting saddle constructed to engage the pier such that the lifting saddle is slidable upward and downward along the pier; and a bracket adapted to engage the edge of the foundation;

the lifting saddle being configured to support the bracket such that upward movement of the lifting saddle causes the bracket to lift the edge of the foundation, at least one of the bracket and lifting saddle being configured to allow the bracket to pivot about at least one horizontal axis relative to the pier.

2. The lifting assembly of claim 1, wherein the bracket is pivotable relative to the lifting saddle about at least one horizontal axis.

3. The lifting assembly of claim 2, wherein the lifting saddle includes a generally horizontal support member configured to project from the pier toward the edge of the foundation, the bracket being supported by the generally horizontal support member and being pivotal relative thereto about at least one horizontal axis.

4. The lifting assembly of claim 3, wherein the bracket includes a generally horizontal portion having a generally planar upper surface adapted to engage a lower surface of the edge of the foundation, the generally horizontal portion of the bracket being configured to rest upon the generally horizontal support member of the lifting saddle.

5. The lifting assembly of claim 4, wherein the generally horizontal portion of the bracket and the generally horizontal support member of the lifting saddle present opposing contact surfaces that form a rolling contact therebetween so as to provide pivotal movement of the bracket relative to the lifting saddle.

6. The lifting assembly of claim 5, wherein the bracket includes a convex member affixed to a lower surface of the bracket and configured to roll in at least one direction upon an upper surface of the generally horizontal support member of the lifting saddle such that the bracket is pivotable about a horizontal axis perpendicular to said direction.

7. The lifting assembly of claim 1, further comprising a load transfer device adapted to engage an upper end of a pier, and lifting and support members connected to the load transfer device and to the lifting saddle for suspending the lifting saddle from the load transfer device.

8. The lifting assembly of claim 7, wherein the load transfer device is configured for engaging a tubular upper end of a pier, the load transfer device including a vertical portion adapted to be slidably received within the upper end of the pier and a support portion adapted to rest atop the upper end of the pier.

9. The lifting assembly of claim 1, wherein the bracket is slidably connected to the lifting saddle such that the bracket can slide relative to the lifting saddle along a horizontal direction that is generally perpendicular to the edge of the foundation.

10. The lifting assembly of claim 9, wherein the lifting saddle includes a generally horizontal support member, and the bracket is configured slide along the generally horizontal support member.

11. The lifting assembly of claim 1, wherein the bracket is pivotable relative to the lifting saddle about a generally vertical axis.

12. The lifting assembly of claim 11, wherein the lifting saddle includes a generally horizontal support member, and the bracket is configured to pivot on the generally horizontal support member about the generally vertical axis.

13. The lifting assembly of claim 1, wherein the lifting saddle is configured to be pivotable relative to the pier about a horizontal axis.

14. The lifting assembly of claim 13, wherein the lifting saddle includes a pair of side members spaced apart and joined by a forward transverse member connected between forward ends of the side members and a rear transverse member connected between rear ends of the side members, the forward and rear transverse members being spaced apart horizontally by a distance exceeding a maximum dimension of the pier disposed between said members so as to enable the lifting saddle to pivot about either of said members relative to the pier.

15. The lifting assembly of claim 14, wherein one of the forward and rear transverse members is operable to be selectively placed at different distances from the other so as to vary a maximum amount of pivotal movement of the lifting saddle.

16. The lifting assembly of claim 1, further comprising a pier adapted to be driven into the ground and to slidably receive the lifting saddle.

17. The lifting assembly of claim 16, further comprising a load transfer device supported on an upper end of the pier, and lift and support members connected between the load transfer device and the lifting saddle, the lift and support members being vertically slidable relative to the load transfer device and including upper portions extending above the load transfer device, and further comprising a jacking device engaging the upper portions of the lift and support members and supported atop the load transfer device, the jacking device being operable to raise the lift and support members upward relative to the load transfer device so as to raise the lifting saddle and bracket.

18. A lifting assembly for use in conjunction with a pier driven generally vertically into the ground proximate an edge of a foundation for lifting the edge of the foundation, comprising:

a lifting saddle constructed to engage the pier such that the lifting saddle is slidable upward and downward along the pier; and a bracket adapted to engage the edge of the foundation; the lifting saddle being configured to support the bracket such that upward movement of the lifting saddle causes the bracket to lift the edge of the foundation, the bracket being slidably connected to the lifting saddle so as to allow the bracket to slide in a horizontal direction relative to the lifting saddle and the pier.

19. The lifting assembly of claim 18, wherein the lifting saddle includes a generally horizontal support member adapted to extend in a forward direction away from the pier toward the foundation, and the bracket is slidable on the generally horizontal support member in the forward direction toward the foundation and in a rearward direction away from the foundation.

20. The lifting assembly of claim 19, further comprising a member for captively retaining the bracket in connection with the lifting saddle while permitting said forward and rearward sliding motion of the bracket relative to the lifting saddle.

21. The lifting assembly of claim 19, wherein the bracket and the lifting saddle are configured such that the bracket is pivotable about a horizontal axis relative to the lifting saddle and pier.

22. The lifting assembly of claim 21, wherein the bracket and the lifting saddle are configured such that the bracket is pivotable relative to the lifting saddle and pier about an axis extending generally parallel to a lengthwise direction of the pier.

23. A method for raising an edge of a foundation, comprising:

securing a bracket to the edge of the foundation, the bracket extending outward from the foundation;

engaging the bracket with a lifting saddle defining a pier-receiving passage therethrough, the lifting saddle supporting the bracket such that upward movement of the lifting saddle causes the bracket to be raised;

driving a pier generally vertically into the ground proximate the edge of the foundation;

disposing the pier within the pier-receiving passage of the lifting saddle;

raising the lifting saddle upward along the pier to a desired height; and allowing the bracket to pivot about at least one horizontal axis relative to the pier during the raising operation.

24. The method of claim 23, wherein the bracket is allowed to pivot relative to the lifting saddle about a horizontal axis extending generally perpendicular to the edge of the foundation.

25. The method of claim 23, further comprising allowing the bracket to slide relative to the lifting saddle along a horizontal direction toward or away from the foundation.

26. The method of claim 23, further comprising allowing the bracket to pivot relative to the lifting saddle about an axis extending generally parallel to a lengthwise direction of the pier.

27. A lifting device for raising an edge of a foundation, comprising:

a pier adapted to be positioned in the ground such that an upper portion of the pier is disposed adjacent the edge of the foundation, at least the upper portion of the pier being tubular; and a lifting assembly including a foundation-engaging portion adapted to provide vertical support to the foundation, and a pier-engaging portion in sliding engagement with the upper portion of the pier and supporting vertical loads imposed on the foundation-engaging portion;

the lifting assembly being constructed and arranged such that the foundation-engaging portion has multiple degrees of freedom of movement relative to the pier-engaging portion.

28. The lifting device of claim 27, wherein the pier-engaging portion is configured to be pivotable on the pier about a first horizontal axis.

29. The lifting device of claim 28, wherein the foundation-engaging portion is pivotable relative to the pier-engaging portion about a second axis that is generally perpendicular to the first axis.

* * * * *